US005884635A

United States Patent [19]

O'Brien et al.

[11] Patent Number: 5,884,635

[45] Date of Patent: Mar. 23, 1999

[54] CLAMPING HAIR CURLER SYSTEM

[76] Inventors: Aideen Connolly O'Brien, 317 Birmingham Way, Exton, Pa. 19341; Felix P. Connolly, 1443 Snuff Mill Rd., Hockessin, Del. 19707

[21] Appl. No.: 61,632

[22] Filed: Apr. 16, 1998

Related U.S. Application Data

[60] Provisional application No. 60/044,072 Apr. 17, 1997.

[51] Int. Cl.[6] ..... A45D 2/36

[52] U.S. Cl. ..... 132/227; 132/234; 132/255

[58] Field of Search ..... 132/210, 231, 132/232, 234, 255, 263, 266, 226, 227; 219/222, 225, 226

[56] References Cited

U.S. PATENT DOCUMENTS

| | | | |
|---|---|---|---|
| 1,510,359 | 9/1924 | Van Gale | 132/255 |
| 1,546,046 | 7/1925 | Thompson, Jr. | 132/263 |
| 3,173,429 | 3/1965 | Pauldine | 132/234 |
| 3,291,141 | 12/1966 | Quinio et al. | 132/33 |
| 3,413,984 | 12/1968 | Tracy et al. | 132/34 |
| 3,426,766 | 2/1969 | Castellano | 132/34 |
| 3,612,070 | 10/1971 | Reyes | 132/34 |
| 3,696,820 | 10/1972 | Lara | 132/40 |
| 4,029,110 | 6/1977 | Hyland | 132/33 R |
| 4,130,122 | 12/1978 | Kennedy | 132/238 |
| 4,210,163 | 7/1980 | Savage et al. | 132/33 R |
| 4,222,398 | 9/1980 | Fromman | 132/34 R |
| 4,260,871 | 4/1981 | Nagelkerke | 132/9 |
| 4,419,565 | 12/1983 | McGaw | 219/222 |
| 4,884,583 | 12/1989 | Long, Jr. | 132/238 |
| 5,286,949 | 2/1994 | Simons | 219/222 |
| 5,365,037 | 11/1994 | Chan | 219/222 |
| 5,400,810 | 3/1995 | Taylor | 132/232 |
| 5,494,058 | 2/1996 | Chan | 132/228 |
| 5,513,665 | 5/1996 | Chan | 132/228 |
| 5,526,829 | 6/1996 | Smith | 132/229 |
| 5,711,323 | 1/1998 | Denebeim | 132/232 |
| 5,740,820 | 4/1998 | Stern | 132/263 |

OTHER PUBLICATIONS

Service Merchandise 1996/1997 Jewelry, Gift & Home Catalog. pp. 288–290.

*Primary Examiner*—Todd E. Manahan
*Attorney, Agent, or Firm*—Ratner & Prestia

[57] ABSTRACT

A hair styling device comprising a handle having a first curler interlocking element, a heatable curler having a second curler interlocking element, and a clamp attached to the handle and extending therefrom. The clamp is adapted to grasp hair between the clamp and the curler. The curler has a non-conductive upper rim with a cutaway portion. The clamp, the first interlocking element, and the second interlocking element are adapted to cooperatively secure the curler removably to the handle. Various embodiments for the interlocking elements are provided. The hair styling device may be part of a hair styling system further comprising a plurality of curlers and a heater for heating the curlers. There is also provided a method for curling hair with the hair styling system described.

22 Claims, 7 Drawing Sheets

81
80
B
20
82
21
23
70
71
40
30
75
38

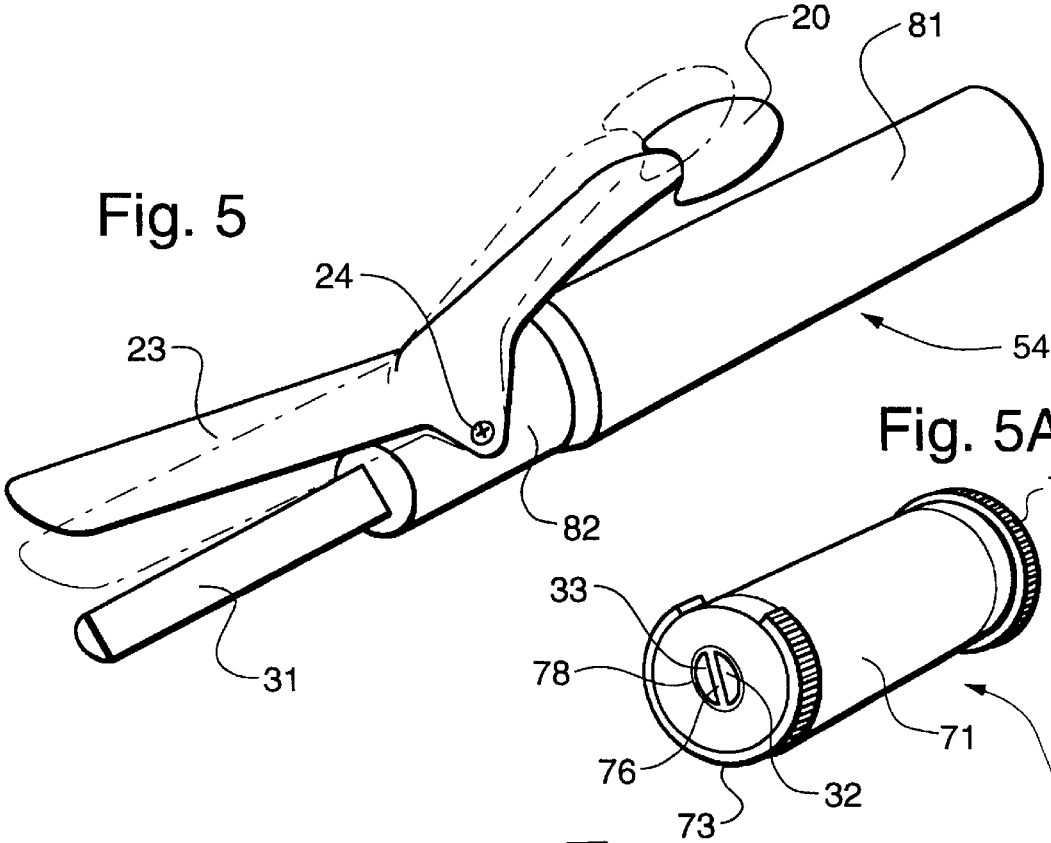
Fig. 5
Fig. 5A
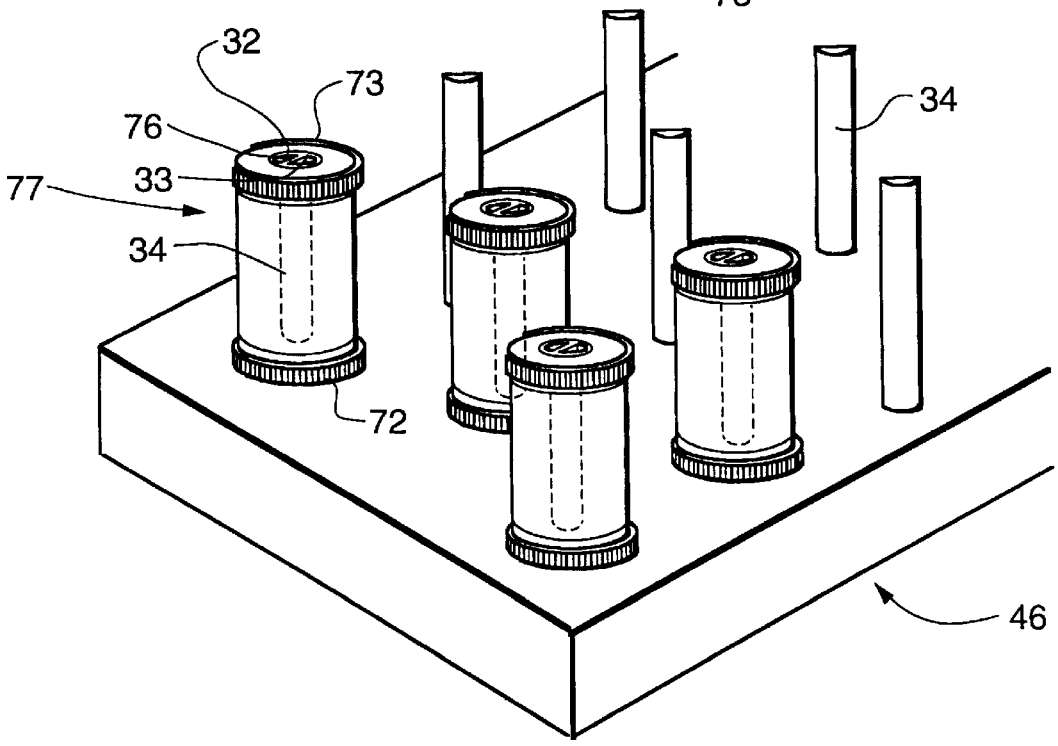

CLAMPING HAIR CURLER SYSTEM

CROSS REFERENCE TO RELATED APPLICATIONS

This application claims priority based on United States provisional application number 60/044,072 filed Apr. 17, 1997, which is incorporated herein by reference.

BACKGROUND OF THE INVENTION

Hair is commonly curled with heated curlers or a curling iron. Conventional hair curlers are well-known in the art and are advantageous in that the user can place as many curlers as desired in the hair and then go about other activity while the curls set. The curlers can be left in the hair for the desired amount of setting time and are capable of providing as firm and long-lasting curls as the hair will hold. Several different size curlers can be used to vary the size or tightness of the curls. One disadvantage of curlers is the difficulty in grasping hair ends and then winding the hair smoothly and securely around individual curlers. Another disadvantage is the necessity for finger contact with the hot curlers, particularly when picking them up or grasping a section of hair to the curler to begin the process of winding the hair around the curler. Because of these disadvantages, using curlers can be cumbersome and painful.

Standard curling irons are also well known in the art and are advantageous in that they have a handle that eliminates finger contact with any hot surface and provides a clamp for grasping the hair to the barrel of the curling iron, thereby making it easy to begin winding the hair and ensuring that the hair is smoothly and securely wound. A curling iron, however, must be manually held the entire time each section of hair is being curled, so that curls can only be formed serially, with the curling of each hair section being completed before the next is begun. This process, which is repeated until all curls are completed, can be tiresome and lengthy, or result in curls that fall out easily if the user grows impatient and uses insufficient setting time. Moreover, most curling irons have only a single barrel, resulting in only one size curl.

Thus, a hair curling system is desirable which would have the advantages of both heated curlers and a curling iron, without their disadvantages. The prior art contains several combination curling iron/hair curler devices, none of which fully meets this need. Therefore, it is the object of the present invention to provide a hair styling device that provides a handle-curler combination that allows a user to manipulate a curler without touching the hot portions, that allows a user to clamp their hair to the curler to begin the rolling process, and that allows easy disengagement of the curler from the handle in the user's hair.

SUMMARY OF THE INVENTION

In accordance with the present invention there is provided a hair styling device comprising a handle, a curler, and a clamp. The handle includes a gripping portion and a first curler interlocking element for removably attaching a curler onto the handle. The curler handle has an axis extending through the handle.

The curler itself is heatable and substantially-cylindrical, and it has a curler axis, a body portion, an upper end rim, and a second curler interlocking element. The curler body portion has a body diameter and an outer surface. The curler upper end rim has a rim circumference and a rim diameter, the rim diameter being larger than the body diameter, and the upper end rim having a cutaway portion in the circumference. The second curler interlocking element is adapted to receive the first curler interlocking element in a non-rotational engagement with the curler and the handle axes coincident.

The clamp is attached to the handle and movable between a closed position wherein the clamp extends through the cutaway portion over the curler body outer surface substantially parallel therewith when the curler is attached to said handle, and an open position wherein the clamp is away from the curler body outer surface.

The hair styling device may further comprise a plurality of curlers and a curler support adapted to store and simultaneously heat the plurality of curlers. The first interlocking element may comprise a single shaped rod, two substantially-parallel rods, a non-circular lug, or a semi-cylindrical post, wherein the second interlocking element comprises a complimentary receptacle therefore.

BRIEF DESCRIPTION OF THE DRAWINGS

The invention will be described with reference to the following figures:

FIG. 5 illustrates an embodiment of the invention with a handle having a half-cylinder interlocking mechanism.

FIG. 5A illustrates a curler with central portion fitting the handle of FIG. 5.

DETAILED DESCRIPTION

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
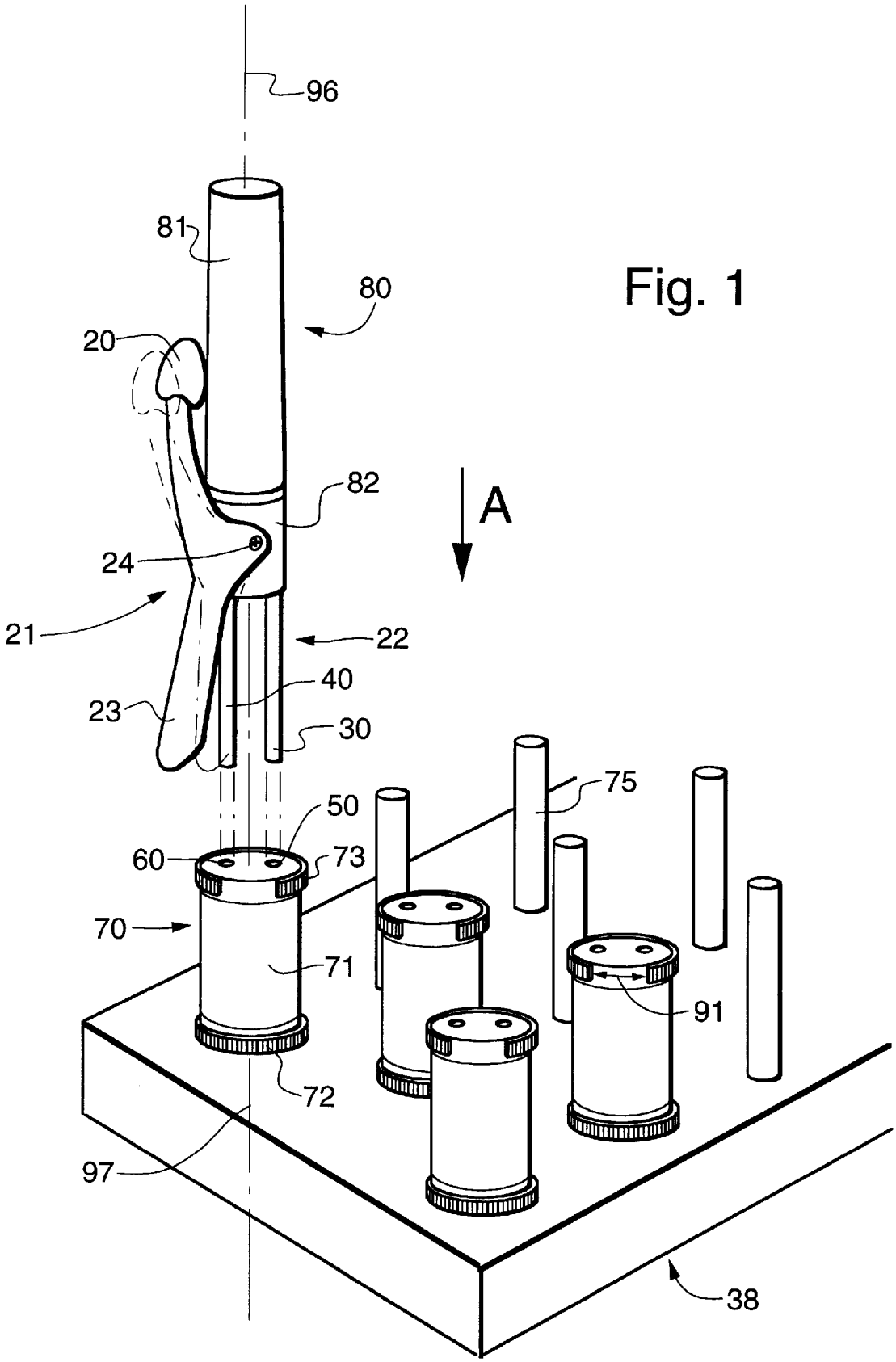
FIG. 1 illustrates a set of heatable curlers and a handle with clamping and interlocking mechanisms joined to a curler.

Referring to FIG. 1, there is shown a handle 80 with gripping portion 81, base portion 82, first curler interlocking element 22 for detachably joining the handle to a curler 70, and a clamping mechanism 21. Gripping portion 81 is made of a non-conductive material such as the hard plastic commonly used for the gripping portion of a curling iron. Clamping mechanism 21 has a clamp 23 made of durable, thin, smooth metal, such as is used for the clamps of many curling irons, preferably coated with a non-stick material. The clamping mechanism also has a release lever 20 which when depressed enables clamp 23 to pivot about axis 24 into an open position (solid lines). Clamp 23 is usually biased closed (dashed lines) by a spring mechanism (not visible) located between the handle and the clamp. Other known release mechanisms for the clamp can be used such as a button or trigger positioned on the handle.

FIG. 1 also shows a plurality of heatable, substantially-cylindrical curlers 70, similar to conventional curlers known in the art, being heated by metal rods 75 of a curler support 38. The curlers preferably have a heat-conductive core, which may also be partially filled with a meltable wax that helps to evenly distribute and retain heat in the curler. Other heating sources can be used, such as metal nubbins or steam, as long as the heating source allows access by the handle to the tops of the curlers. In an alternate embodiment, the heating source may also be provided from within the handle itself, wherein curler support 38 serves merely as a curler holder, or be unnecessary altogether as each curler may be manually threaded onto the handle prior to heating. However, because of the time-saving advantage of having all the curlers heated prior to attaching the handle to the curler, a separate heating unit such as curler support 38 is preferred. Finally, heat may be applied both in the curler support 38 by the metal rods 75 and by the handle itself once a curler has been picked up.

Each curler has a body portion 71 with rims 72 and 73 disposed circumferentially about each axial end, said rims preferably made of nonconductive material such as plastic, so that the rims do not get hot, or at least not as hot as the body portion 71 of the curlers. The diameter of the rims is slightly larger than the diameter of body portion 71, so that the rims help to keep the hair to be curled between the rims. The upper rim 73 also has at least one cutaway portion 91 in its circumference. The body portions of the curlers may be covered with a velvety material (flocked) for protection of the hair as is commonly used on heated curlers.

Clamp 23, which fits over a curler 70, preferably is curved with a curvature substantially the same as that of the curler. The clamp is sufficiently wide to grasp hair ends of a section of hair to the curler without a significant number of loose hairs. The handle can be used with curlers of various diameters (and hence various curvatures), and one skilled in the art can easily optimize the curvature and width of clamp 23 to accommodate any number of curler diameters.

First interlocking element 22 of handle 80 is comprised of substantially parallel rods 30 and 40 protruding from and fixed to base portion 82 of the handle. Rods 30 and 40, which are preferably made of a durable rigid metal or plastic, are receivable by corresponding ports or receptacles 50 and 60 bored axially in curler 70. Ports or receptacles 50 and 60 comprise a second curler interlocking element that interlocks with first curler interlocking element 22 in a frictional, non-rotational engagement. The receptacles form a close fit with the rods, providing just sufficient frictional engagement so that a curler remains engaged on the rods when the handle is held vertically with the curler below the handle. Preferably, for ease of insertion, the receptacles are larger in diameter at the top of the curler before tapering down to form a close fit with the rods.

Handle 80 has a central axis 96 about which the first curler interlocking element 22 is centered. Curler 70 also has a central axis 97 about which the second curler interlocking element (receptacles 50 and 60) is centered. Thus, curler 70 mounts on handle 80 such that the axes 96 and 97 are coincident.

Curler 70, when joined to handle 80 by insertion of rods 30 and 40 into receptacles 50 and 60, forms a rigid extension of the handle. Upper rim 73 has one or more cutaway portions 91 so that clamp 23 is able to fit within the cutaway portion to rest on and parallel to the outer surface of body portion 71 of curler 70 when the clamp is in the closed position. Most existing conventionally-sized, non-hollow curlers in the art have sufficient diameter to permit minimal modification for incorporation of the receptacles so that the curlers can be used with handle 80. One skilled in the art can easily optimize the spacing of the rods and receptacles to accommodate various curler diameters.

Alternative interlocking elements are used in other embodiments of the invention. The interlocking elements can be comprised of more than two rods that are received by a corresponding number of receptacles in the curlers. The rods preferably are substantially parallel (i.e. any two rods are substantially equidistant from each other along their entire lengths), but the rods need not all be in the same plane. Alternatively, a single shaped rod, preferably non-cylindrical, can comprise the first curler interlocking element which is received by a correspondingly-shaped receptacle in the curler as the second curler interlocking element. For example, the interlocking mechanism may comprise a single square rod received by a corresponding square receptacle of the curler that is located so as not to interfere with the curler's heating source. The curler may have a rod that fits into a receptacle in the handle, or handle may have a rod that penetrates halfway down the axial length of the curler from the upper end, while the curler sits on a curler heating element post that penetrates halfway up the axial length of the curler from the lower end.

FIGS. 5 and 5A show an embodiment of the invention with a handle 54 and heatable curlers 77 in a curler support 46 having a modified heating source with half-cylindrical heating posts 34. As shown in FIG. SA, curler 77 has a cylindrical receptacle 78 that is separated into half-cylindrical receptacles 32 and 33 by a thin central divider 76 that prevents rotation of the curler on the half-cylindrical posts. Receptacle 78 is preferably made of heat-conductive material. The half-cylindrical receptacles are aligned so that the flat portions of their semicircular cross-sections are aligned along the handle axis. The first interlocking element of handle 54 is comprised of a half-cylindrical rod 31 protruding from base portion 82 of handle 54. Rod 31 fits into half-cylindrical receptacle 32 that comprises the second interlocking element of curler 71. The other half-cylindrical receptacle 33 of curler 77 slides easily over half-cylindrical heating posts 34.

Figure 6:
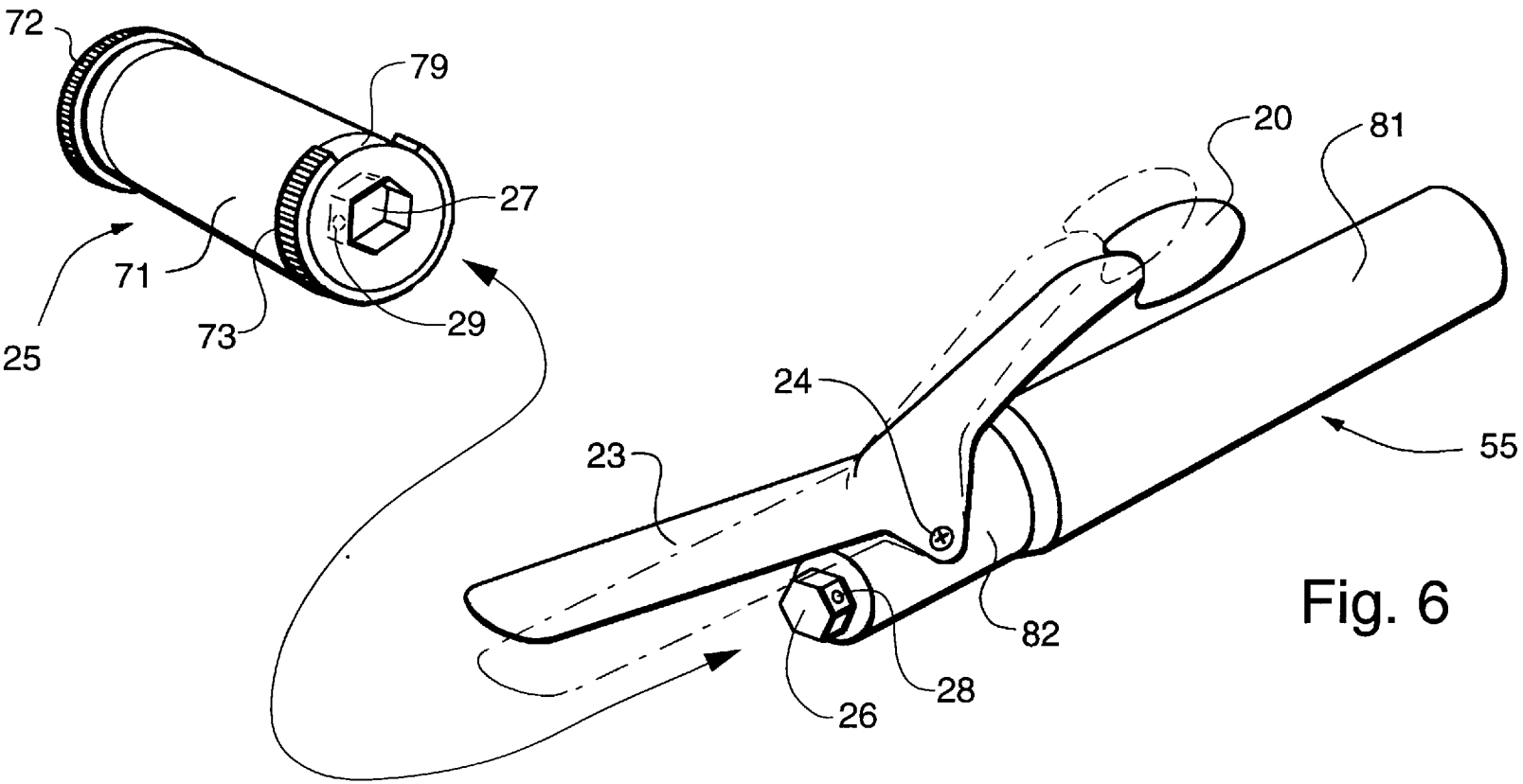
FIG. 6 illustrates an embodiment of the invention with lug and spring-catch interlocking mechanism.

In another embodiment as shown in FIG. 6, the first interlocking element of handle 55, instead of one or more rods, is a single lug 26 preferably in a shape such as a square, pentagon, hexagon, octagon or oval. Lug 26 is received by the top portion 79 of a heatable curler 25 having a correspondingly-shaped lug receptacle 27 that comprises the second interlocking element. Receptacle 27 may penetrate inside curler 25 or may be an appendage thereto. Lug 26 is made from any suitable material such as metal or plastic. Preferably, in order to provide a small amount of friction sufficient to prevent curler 25 from falling off handle 55 by force of gravity when clamp 23 is open (solid lines), nodule 28 protruding from lug 26 is received by a corresponding concave indentation 29 within lug receptacle 27. Nodule 28 and indentation 29 act as a conventional spring-catch mechanism. Various other methods may be used to provide such friction, or to increase or decrease the friction between the lug and its corresponding receptacle, such as by the use of a magnetic link between the lug and receptacle.

In other embodiments of the invention, the first interlocking element may be a receptacle and the second interlocking element may be an appendage. For example, the lug described in the above embodiment can be the second interlocking element located on the curlers and the receptacle can be the first interlocking element located on the handle.

Figure 7:
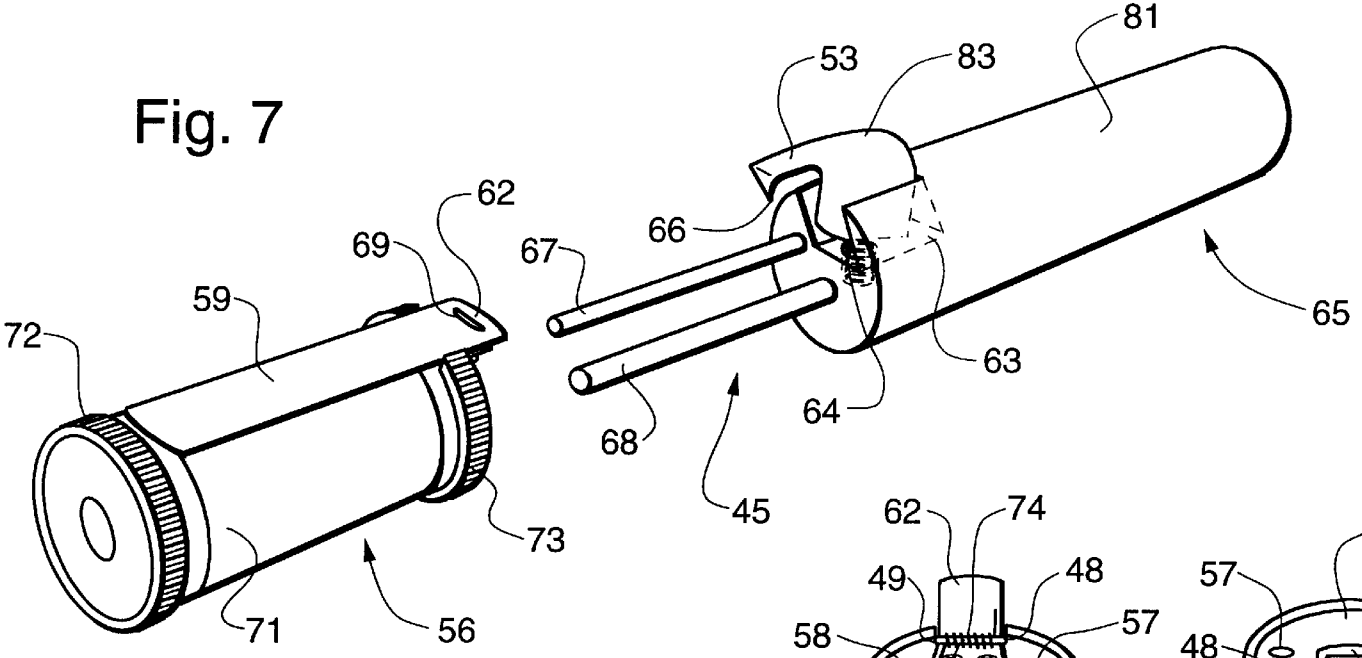
FIG. 7 illustrates an embodiment of the invention with a clamp attached to a curler and clamp release lever attached to the handle.

In other embodiments of the invention, different clamping mechanisms are used. In one embodiment shown in FIG.7, clamp 59 is attached to heatable curler 56 and is workable by lever 83 attached to handle 65 when the handle is joined to curler 56 with first interlocking element 45. First interlocking element 45 is comprised of rods 67 and 68 having different diameters that are received by the second interlocking element—corresponding receptacles 57 and 58 of curler 56. The difference in diameters allows the user only one way to insert the rods into the corresponding receptacles so that lever 83 and clamp 59 always join together properly.

Figure 7A:
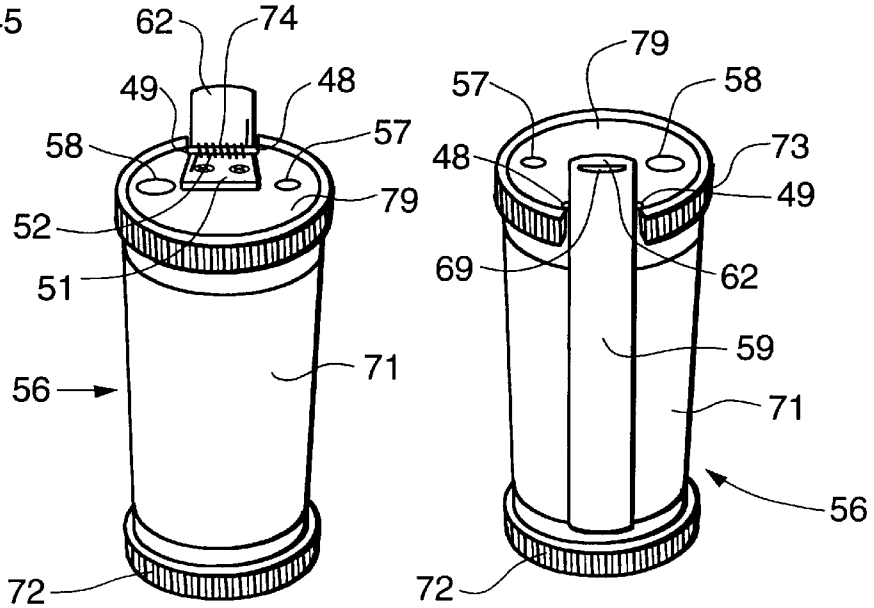
FIG. 7A illustrates opposite side views of the curler which fits with the handle of FIG. 7.

As shown in FIG. 7A, clamp 59 is attached to the top portion 79 of the curler with a screwed-on plate 51 that is linked to the clamp by means of an axle 52 having ends 48 and 49 and a spring 74 around it. Once rods 67 and 68 are inserted into receptacles 57 and 58, front portion 53 of lever 83 lies on top of protruding portion 62 of clamp 59, and catch 66 is received by a corresponding indentation 69. Handle 65 thus firmly holds curler 56, allowing removal of the curler from the heating source for styling.

When a user presses front portion 53 of lever 83 with one finger, protruding portion 62 of the clamp pivots downward, compressing spring 64 and causing clamp 59 to lift off of body portion 71 of curler 56. The hair is then inserted, lever 83 is released, clamp 59 grasps the hair, and the process for rolling the hair is continued. When the hair section has been rolled to the user's head, the same procedure detailed for curler 70 and handle 80 is used to detach curler 56 from handle 65. In this embodiment, however, lever 83 is not pressed to detach handle 65. Rather, handle 65 simply can be pulled by one hand from curler 56 while the other hand supports or grasps plastic rim 72. The clamp and curler remain on the head.

Figure 2:
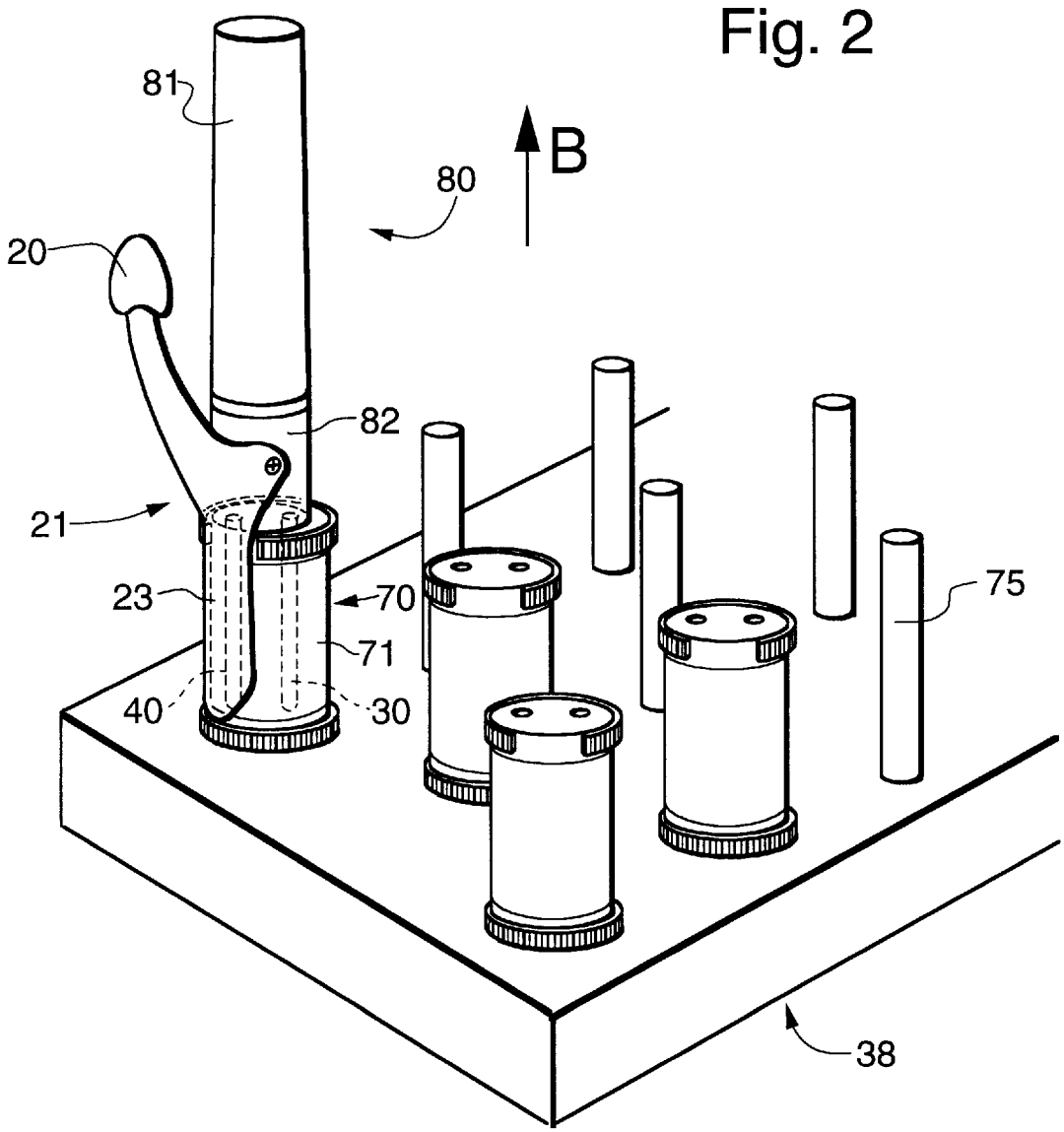
FIG. 2 illustrates a curler being removed from a heating rod with the handle.

Referring now to FIGS. 1 and 2, the use of handle 80 to remove a curler from its heating source and style the hair will now be described. Once the curlers are heated in curler support 38, a user grasps handle 80 with one hand on gripping portion 81 to pick up each curler 70 from its resting position on metal rod 75. Handle 80 with release lever 20 depressed so that clamp 23 is open, is moved along arrow "A" while rods 30 and 40 are guided and inserted into corresponding receptacles 50 and 60 of curler 70. A user may perform this operation using one hand to grip the handle 81 with one finger pressing release lever 20. Once the rods are inserted completely, clamp 23 is released by release lever 20 so that the clamp rests securely in cutaway portion 91 of rim 73 and across the length of body portion 71 of the curler.

Handle 80 is then used to pull up curler 70 in the direction of arrow "B" to remove it from metal rod 75. FIG. 2 illustrates the cooperation of the first and second interlocking elements (rods 30 and 40 and receptacles 50 and 60 respectively) with the clamp biased against the curler, thus allowing handle 80 to remove curler 70 from heating source 38. This process allows curler 70 to be removed from metal rod 75 by use of only one hand and with no finger contact with the hot curler.

As shown in FIG. 2, clamp 23 when biased against curler 70 provides a secure hold on the curler while the curler is joined to handle 80 by interlocking rods 30 and 40 and receptacles 50 and 60. Thus, the cooperation of the interlocking and clamping elements provides a firm hold of curler 70 so that it can be removed from heating source 38 and carried to the hair by a user holding the handle with one hand and without finger contact on the hot curler. Even with clamp 23 open and the handle in a vertical position with the curler below the gripping portion 81, the friction between the first and second interlocking elements is preferably just sufficient to prevent curler 70 from falling off handle 80 by force of gravity alone. The friction is slight enough, however, to still allow ready detachment of the handle from the curler when in the hair as described below. Various modifications can be made to receptacles 50 and 60 and rods 30 and 40 to increase or decrease, to the extent desired, the friction of the rods against the sides of the receptacles, such as to angle slightly the rods or the receptacles, or to modify the materials used or the cross-sectional shape or length of the rods and receptacles.

Figure 3:
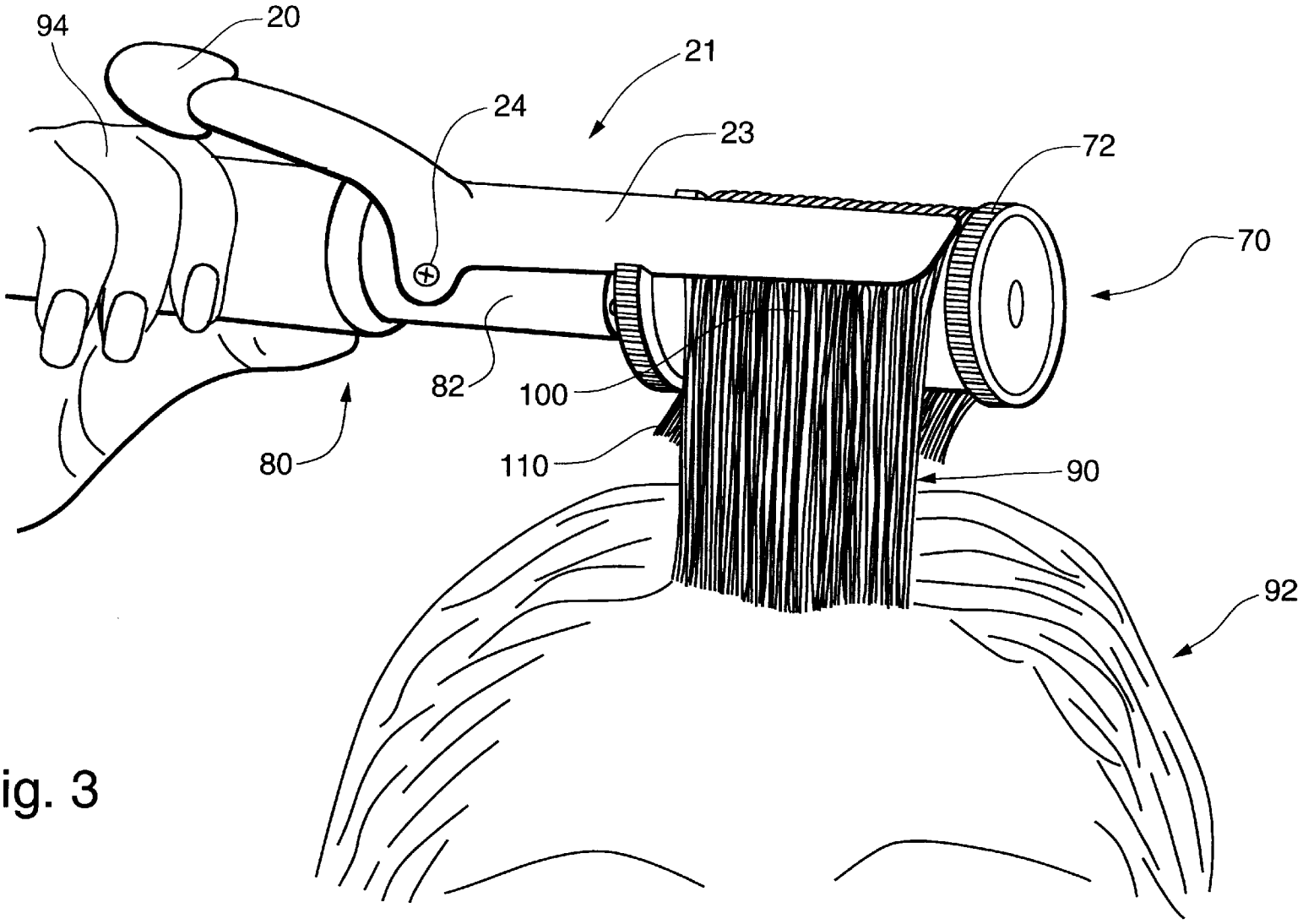
FIG. 3 illustrates the beginning application of a section of hair onto a curler which is detachably joined to the handle.

Referring now to FIG. 3, curler 70 held by the handle 80 being grasped by one hand 94 of a user, is then applied to a section of hair 90 that has been pulled away from head 92 (usually by the user's opposite hand, not shown). Lever 20 is pressed down by a finger of hand 94 to open clamp 23 and lift it off curler 70 to create a gap between curler 70 and clamp 23. The upper portion 100 of the section of hair 90 is inserted into the gap (usually by the hand, not shown, holding section of hair 90), without finger contact with the hot curler.

Lever 20 is then released to close clamp 23 so that the upper portion 100 of hair section 90 is clasped between curler 70 and clamp 23 in its resting position. The curler and clamp are then guided slowly, by moving handle 80, toward the end portion 110 of hair section 90, until only the desired length of hair is visible beyond the clamp. Clamp 23 securely grasps end portion 110 of hair section 90 to curler 70.

Curler 70 is then rolled toward head 92 by rotation of handle 80 with one hand 94, so that hair section 90 is securely wrapped around the curler. If desired, the opposite hand (not shown) can, with only limited touching of non-conductive rim 72 of curler 70, assist or guide in the rolling of the curler.

Figure 4:
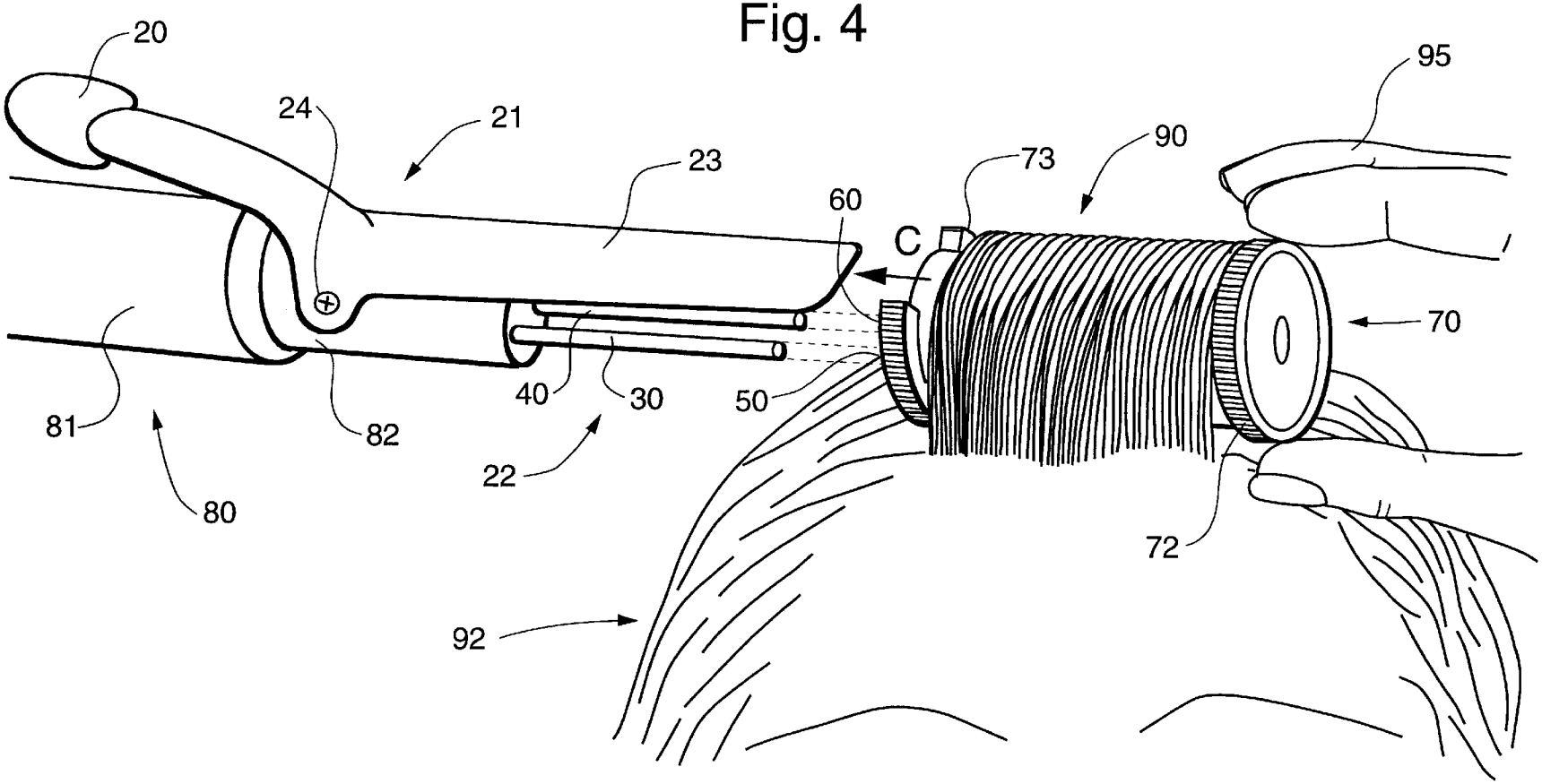
FIG. 4 illustrates the detachment of the handle from a curler with hair wound around it.

As shown in FIG. 4, the cooperation of the interlocking and clamping mechanisms allows the curler to be easily detached from the handle as follows. While lever 20 is barely pressed by one finger to lift clamp 23 slightly from its resting position and with minimal use of the other hand 95 to support or grasp plastic rim 72 of curler 70, handle 80 is readily pulled from the curler in the direction of arrow "C". Once curler 70 has been rolled to head 92 and handle 80 has been detached from the curler, the curler is secured with a curler clip (not shown) such as those commonly known in the art and commercially available, and the curler is left securely on the head.

While it is preferred that the interlocking elements of this device engage with sufficient friction to assure that the curler remains on the handle during use, cut-away portion 91 in curler upper rim 73 which allows clamp 23 to lie flat against body portion of the curler provides added security against accidentally dropping the curler, even when the frictional engagement alone between the interlocking elements is insufficient to maintain the curler on the handle.

The curling process described above is then completed for the plurality of curlers necessary to achieve the desired hairstyle. After the curlers have remained in the hair for sufficient time to achieve the desired amount of curl, the curlers are removed from the hair.

Although various embodiments of the invention have been described, it will be understood that the invention is not limited to these embodiments, but is capable of numerous modifications of parts, elements and materials without departing from the invention.

What is claimed:

1. A hair styling device, comprising:

a handle including a gripping portion and a first curler interlocking element for removably attaching a curler onto the handle, the curler handle having an axis extending through said handle;

a heatable, substantially-cylindrical curler having a curler axis, a body portion, an upper end rim, and a second curler interlocking element, said body portion having a body diameter and an outer surface, said upper end rim having a rim circumference and a rim diameter, said rim diameter being larger than said body diameter, said upper end rim having a cutaway portion in said circumference, and said second curler interlocking element adapted to receive said first curler interlocking element in a non-rotational engagement with said curler and said handle axes coincident; and a clamp attached to said handle and movable between a closed position wherein said clamp extends through said cutaway portion over the curler body outer surface substantially parallel therewith when said curler is attached to said handle, and an open position wherein the clamp is away from the curler body outer surface.

2. The hair styling device of claim 1 wherein the second curler interlocking element receives the first curler interlocking element in frictional engagement with just sufficient friction to prevent the curler attached to the handle from disengagement when the handle is held in a vertical position wherein the curler is at a position below the gripping portion of the handle.

3. The hair styling device of claim 1 wherein the first curler interlocking element comprises a shaped rod extending in the direction of the axis and the second curler interlocking element comprises a complimentary receptacle in the curler body for accepting the first curler interlocking element.

4. The hair styling device according to claim 3 wherein the shaped rod has a semicircular cross-section having a curved and a flat portion, and extends along the handle axis with said axis on said flat surface, and wherein the complimentary receptacle in the curler also extends along the curler axis and is a cylindrical receptacle having at least one rotation-preventing bar extending along a diameter of the receptacle.

5. The hair styling device of claim 1 wherein said curler further comprises a lower end rim having a rim circumference and a rim diameter, said rim diameter being larger than said body diameter, and wherein both said lower end rim and said upper end rim are non-conductive.

6. The hair styling device of claim 1 further comprising a heater adapted to heat said curler.

7. The hair styling device of claim 1 wherein the first curler interlocking element comprises at least two substantially parallel rods extending from said handle, and the second curler interlocking element comprises two substantially parallel receptacles in said curler adapted to fit said rods.

8. The hair styling device of claim 1 wherein the first curler interlocking element comprises at least one lug, and the second curler interlocking element comprises a receptacle adapted to fit said lug.

9. A hair styling system comprising:

a handle including a gripping portion and a curler interlocking element for removably attaching a curler onto the handle, the handle having an axis extending through said handle;

a plurality of heatable, substantially-cylindrical curlers each having a curler axis, a body portion, an upper end rim, and an interlocking element receptacle, said body portion having a body diameter and an outer surface, said upper end rim having a rim circumference and a rim diameter, said rim diameter being larger than said body diameter, said upper end rim having a cutaway portion in said circumference, and said interlocking element receptacle adapted to receive in frictional and positive non-rotational engagement said curler interlocking element with said curler and said handle axes coincident;

a clamp attached to said handle and movable between a closed position wherein said clamp extends through said cutaway portion over the curler body outer surface substantially parallel therewith when said curler is attached to said handle, and an open position wherein the clamp is away from the curler body outer surface; and a curler support adapted to store and simultaneously heat said plurality of curlers.

10. The hair styling device of claim 9 wherein each of said plurality of curlers further comprises a lower end rim having a rim circumference and a rim diameter, said rim diameter being larger than said body diameter, and wherein both said lower end rim and said upper end rim are non-conductive.

11. The hair styling device of claim 9 wherein the curler interlocking element comprises a shaped rod extending in the direction of the axis.

12. The hair styling device of claim 9 wherein the curler interlocking element comprises at least two substantially parallel rods extending from said handle, and each interlocking element receptacle in each of said curlers comprises two substantially parallel receptacles adapted to fit said rods.

13. The hair styling device of claim 9 wherein the curler interlocking element comprises a lug.

14. The hair styling device according to claim 11 wherein the shaped rod has a semicircular cross-section having a curved and a flat portion, and extends along the handle axis with said axis on said flat surface, and wherein the complimentary receptacle in the curler also extends along the curler axis and is a cylindrical receptacle having at least one rotation-preventing bar extending along a diameter of the receptacle.

15. A method for curling hair with a hair styling device comprising a handle including a gripping portion and a first curler interlocking element; a heatable curler having a second curler interlocking element, a body portion, and an upper and lower non-conductive end rim, the upper end rim having a cutaway portion; a clamp attached to said handle and extending therefrom; and a heater for heating said curler, the method comprising:

a) heating said curler on said heater;

b) attaching said curler to said handle without placing a hand on said curler body portion, by joining together said first curler interlocking element with said second curler interlocking element and closing said clamp against said curler with said clamp resting in said upper rim cutaway portion;

c) removing said curler from said heater;

d) securing a portion of hair between said curler and said clamp;

e) rolling said portion of hair onto said curler;

f) securing said curler in said hair and detaching said curler from said handle without placing a hand on said curler body portion, but only on said lower end rim;

g) leaving said portion of hair on said curler for a desired time interval; and h) removing said curler from said hair.

16. A hair styling system comprising:

a handle including a gripping portion and a first curler interlocking element for removably attaching a curler onto the handle, the handle having an axis extending through said handle, and the first curler interlocking element centered around said axis;

a plurality of heatable curlers, each having a curler axis, a second curler interlocking element centered around said curler axis, and a clamp, said second curler interlocking element adapted to receive said first curler interlocking element in a non-rotational engagement with said curler and said handle axes coincident, and said clamp adapted to grasp hair between said clamp and said curler;

a lever attached to said handle, said lever positioned to allow manipulation of said clamp when said curler is attached to said holding device.

17. A heatable, substantially-cylindrical curler having a curler axis, a body portion, an upper end rim, and an interlocking element receptacle, said body portion having a body diameter and an outer surface, said upper end rim having a rim circumference and a rim diameter, said rim diameter being larger than said body diameter, said upper end rim having a cutaway portion in said circumference, said body further comprising a heatable core portion having extending therethrough said interlocking element receptacle adapted to receive in frictional and positive non-rotational engagement, a complimentary interlocking element of a curler lifting handle.

18. The curler according to claim 17 wherein the interlocking element receptacle extends in the direction of the curler axis and has a cross-section other than a circle.

19. The curler according to claim 17 wherein the curler comprises two interlocking element receptacles placed symmetrically around the curler axis.

20. The curler according to claim 17 wherein the heatable core contains a meltable wax.

21. The curler according to claim 17 wherein the interlocking element receptacle is cylindrical, extends along the curler axis and includes a diametrically extending bar.

22. The heatable curler according to claim 17 further comprising a lower end rim, said lower end rim having a rim circumference and a rim diameter, said rim diameter being larger than said curler body diameter, and wherein said upper end rim and said lower end rim are non-conductive.

* * * * *